US011892267B2

(12) United States Patent
Cahill et al.

(10) Patent No.: US 11,892,267 B2
(45) Date of Patent: Feb. 6, 2024

(54) MODULAR RIFLE STOCK

(71) Applicant: TangoDown, Inc., Tucson, AZ (US)

(72) Inventors: Jeffrey Matthew Cahill, Tucson, AZ (US); Daniel Michel, Diamond Bar, CA (US)

(73) Assignee: TangoDown, Inc., Tucson, AZ (US)

( * ) Notice: Subject to any disclaimer, the term of this patent is extended or adjusted under 35 U.S.C. 154(b) by 25 days.

(21) Appl. No.: 17/574,393

(22) Filed: Jan. 12, 2022

(65) Prior Publication Data

US 2022/0290942 A1 Sep. 15, 2022

Related U.S. Application Data

(62) Division of application No. 16/746,819, filed on Jan. 18, 2020, now Pat. No. 11,262,158.

(60) Provisional application No. 62/794,513, filed on Jan. 18, 2019.

(51) Int. Cl.
*F41C 23/14* (2006.01)
*F41C 23/02* (2006.01)

(52) U.S. Cl.
CPC ..... *F41C 23/02* (2013.01); *F41C 23/14* (2013.01)

(58) Field of Classification Search
CPC ..... F41C 23/14; F41C 23/04; F41C 23/20; F41C 23/06; F41C 23/22; F41C 23/02; F41A 3/84
USPC ..... 42/71.01–75.1
See application file for complete search history.

(56) References Cited

U.S. PATENT DOCUMENTS

| | | | | | |
|---|---|---|---|---|---|
| 334,832 | A | 1/1886 | Williams | | |
| 979,123 | A | 12/1910 | Bohrer | | |
| 2,731,753 | A * | 1/1956 | Mathieu | F41C 23/06 | 42/1.06 |
| 3,348,328 | A * | 10/1967 | Robert | F41C 23/04 | 42/73 |
| 7,398,616 | B1 * | 7/2008 | Weir | F41C 23/20 | 42/72 |
| 7,676,977 | B1 * | 3/2010 | Cahill | F16M 11/16 | 248/168 |
| 9,109,855 | B1 * | 8/2015 | Kincel | F41C 23/20 | |
| 9,791,238 | B2 * | 10/2017 | Bowen | F41C 23/14 | |
| 2012/0137563 | A1 * | 6/2012 | Ubl | F41A 21/48 | 42/75.03 |
| 2013/0036645 | A1 * | 2/2013 | Chvala | F41C 23/20 | 42/73 |
| 2015/0345895 | A1 * | 12/2015 | Young | F41A 3/84 | 42/71.01 |
| 2016/0010944 | A1 * | 1/2016 | Downey | F41C 23/14 | 42/74 |
| 2016/0054094 | A1 * | 2/2016 | Colt | F41C 23/14 | 42/75.03 |

(Continued)

*Primary Examiner* — Michael D David
(74) *Attorney, Agent, or Firm* — Crump Law P.C.

(57) ABSTRACT

The buttstock assembly uses a modular design including interchangeable end attachments and sling strap connectors. The interchangeable end attachments allow the buttstock to have different toe heights and configurations for different shooting applications. The interchangeable strap connectors allow the use of either quick-disconnect style sling swivels or more traditional fixed strap loops as desired. The buttstock assembly also uses a "trigger" style locking mechanism to selectively position and lock the buttstock along the length of the extension tube to adjust the overall length of pull of the weapon.

1 Claim, 9 Drawing Sheets

(56) References Cited

U.S. PATENT DOCUMENTS

| | | | | |
|---|---|---|---|---|
| 2016/0187099 | A1* | 6/2016 | Cottle | F41C 23/14<br>42/73 |
| 2017/0205187 | A1* | 7/2017 | Brown | F41C 23/10 |
| 2020/0200505 | A1* | 6/2020 | Brown, Jr. | F41C 27/00 |
| 2020/0240743 | A1* | 7/2020 | Cahill | F41C 23/02 |
| 2020/0400403 | A1* | 12/2020 | Vanek | F41C 23/14 |
| 2021/0239423 | A1* | 8/2021 | Liptak | F41C 23/12 |

* cited by examiner

MODULAR RIFLE STOCK

This is a divisional application of pending U.S. patent application Ser. No. 16/746,819 filed on Jan. 18, 2020, which claims the benefit of U.S. Provisional Application No. 62/794,513 filed Jan. 10, 2019.

This invention relates to adjustable rifle buttstocks used on AR-15 style rifles, and in particular, an adjustable buttstock assembly having modular attachments to accommodate varying toe heights and sling strap connections.

BACKGROUND AND SUMMARY OF THE INVENTION

Adjustable buttstocks mountable to the receiver extension tubes ("buffer tubes") of AR-15/M-16 style rifles and similar shoulder fired weapons are well known in the art. Typically, adjustable buttstocks have locking mechanisms that allow the stock to be selectively positioned along the length of the extension tube to effectively adjust the weapons overall "length of pull." Certain adjustable buttstock designs have incorporated storage compartments, sling strap connectors of various types, and interchangeable buttplates; however, heretofore, the height of the toe of the buttstock, i.e. the over height of the buttstock measured from its end has remained fixed. The height of the toe of the buttstock often interferes with the proper presentation of the weapon on target, particular when the shooter wears ballistic armor plates. The thick armor plates covering the shooter's chest generally prevent the toe of the buttstock from nesting into the shooter's shoulder. This forces the shooter to rest the buttstock against the front of the plate creating a less stable presentation or atop the plate raising the shooter's body position and normal line of sight on the weapon.

The buttstock assembly of this invention uses a modular design including interchangeable end attachments and sling strap connectors. The interchangeable end attachments allow for the stock to have different toe heights and configurations for different shooting applications. The interchangeable strap connectors allow the use of either quick-disconnect style sling swivels or more traditional fixed strap loops as desired. The buttstock assembly also uses a "trigger" style locking mechanism to selectively position and lock the buttstock along the length of the extension tube to adjust the overall length of pull of the weapon. The modular design of the buttstock assembly of this invention provides more flexibility in configuring the buttstock of individual preference and application. The interchangeable end attachments, allow users to configure the buttstock to have a shorter "toe" height for use with plate carriers and similar body armor, or a conventional toe height for traditional applications.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
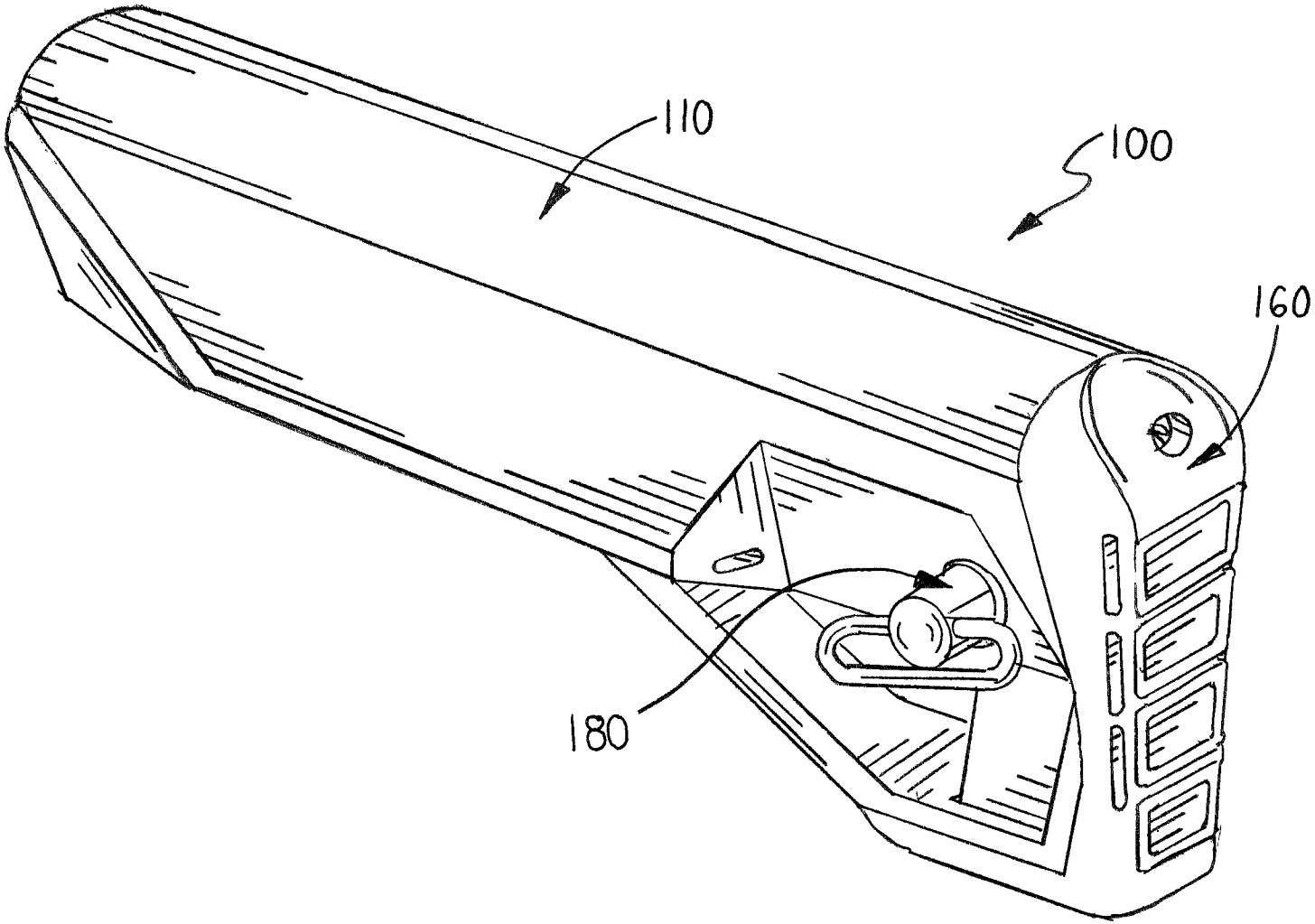
FIG. 1 is a perspective view of an exemplary embodiment of the modular buttstock assembly of this invention.
Figure 2:
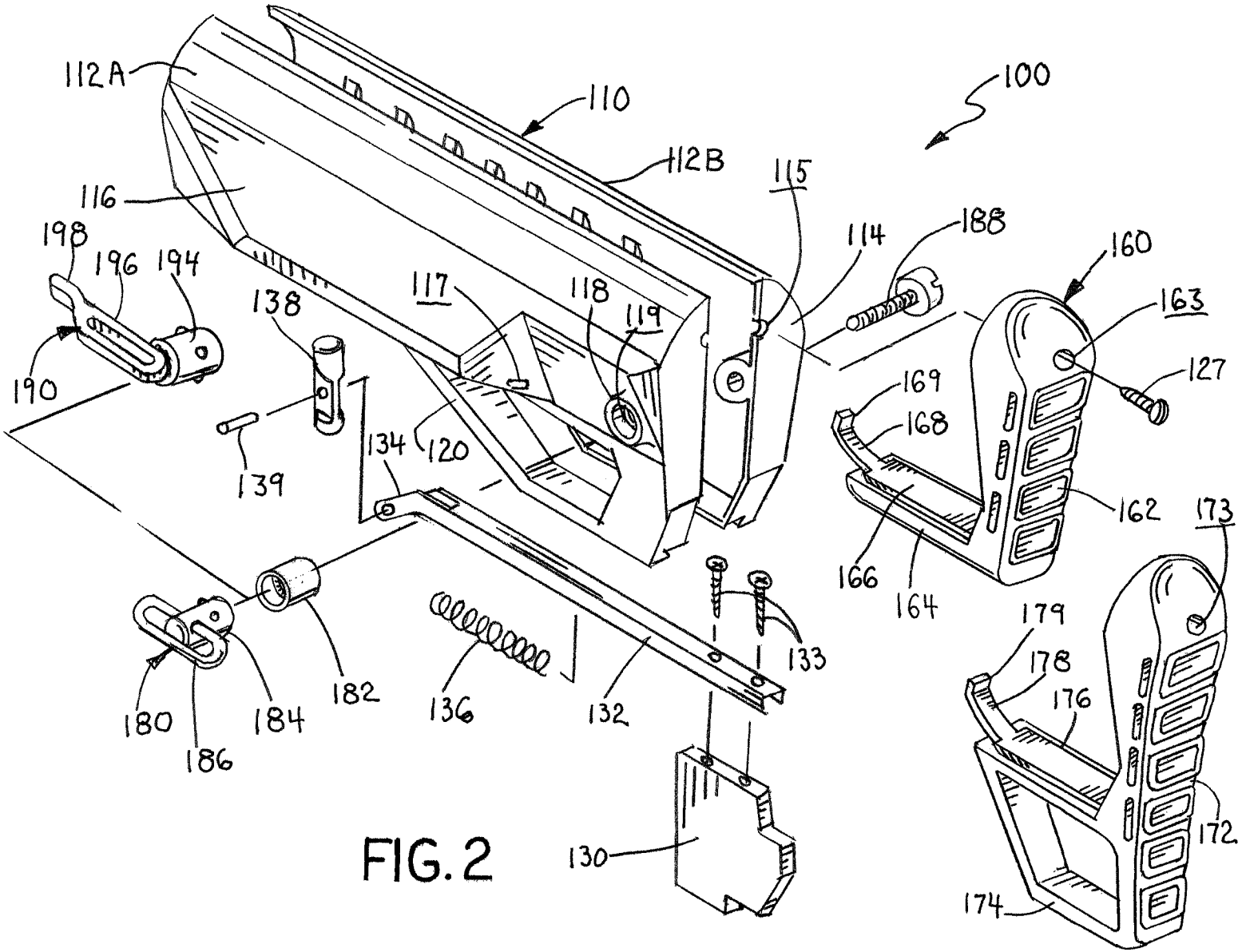
FIG. 2 is an exploded view of the buttstock assembly of FIG. 1.
Figure 3:
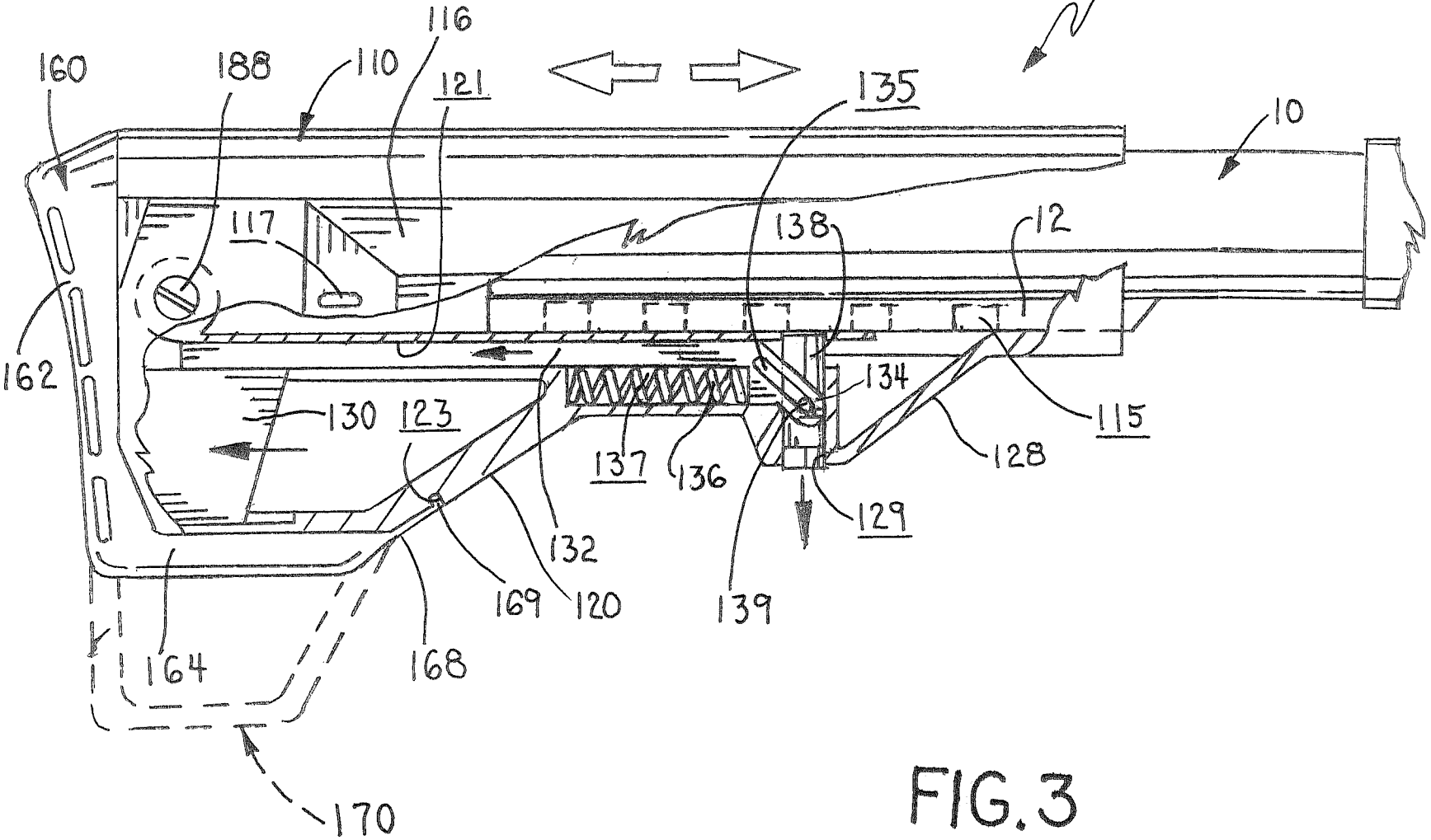
FIG. 3 is a right side view with portions cut away of the buttstock assembly of FIG. 1 showing the locking mechanism in the unlocked position.
Figure 4:
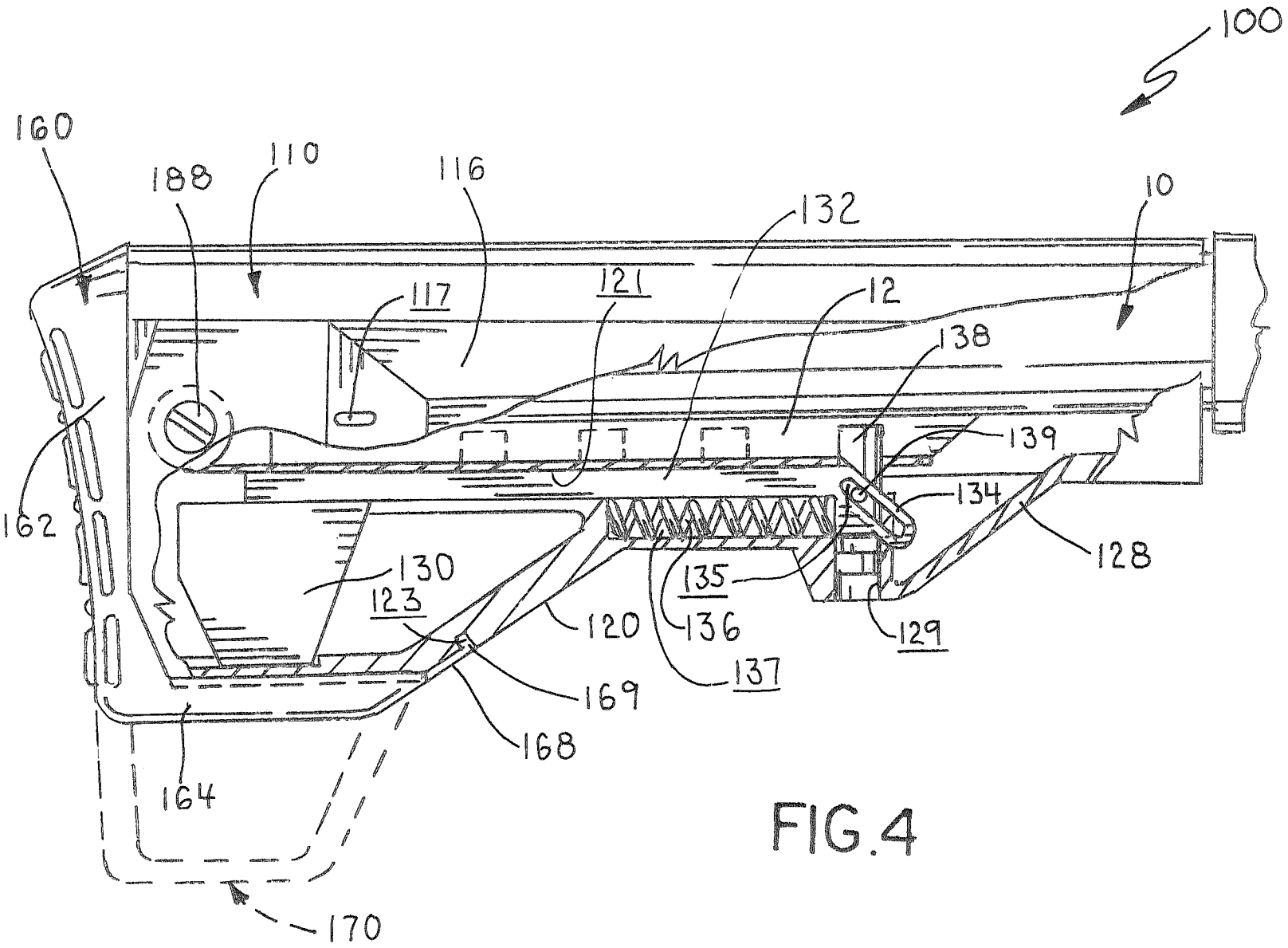
FIG. 4 is a right side view with portions cut away of the buttstock assembly of FIG. 1 showing the locking mechanism in the locked position.
Figure 5:
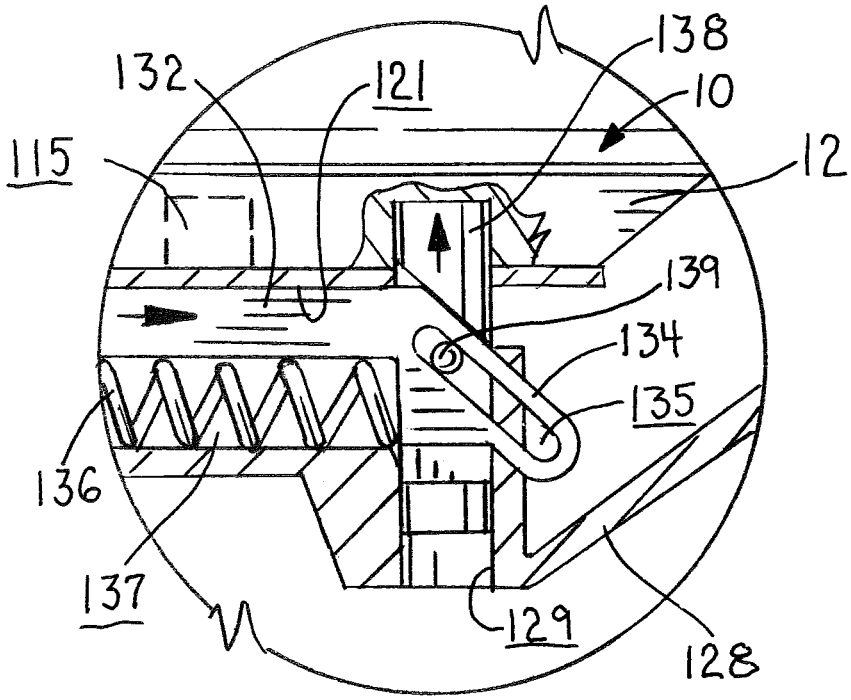
FIG. 5 is partial side view of the locking mechanism used in the buttstock assembly of FIG. 1 showing the mechanism in the locked position.
Figure 6:
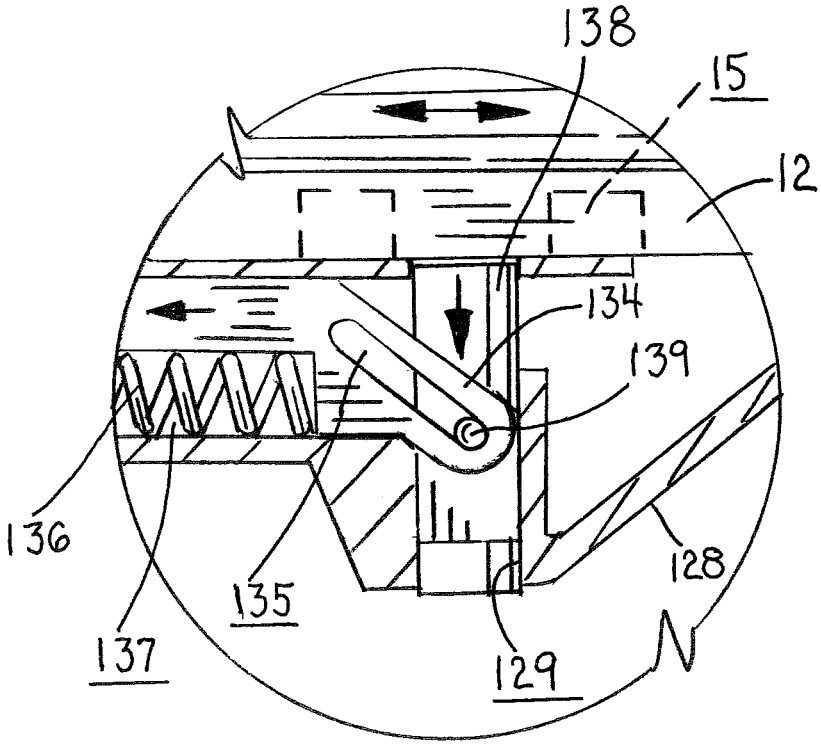
FIG. 6 is partial side view of the locking mechanism used in the buttstock assembly of FIG. 1 showing the mechanism in the unlocked position.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-13 illustrate an exemplary embodiment of the buttstock assembly of the invention, which is designated generally as reference numeral 100. Buttstock 100 is designed and intended to mount on the receiver extension tube of conventional AR-15/M-16 style firearms and other shoulder mounted weapons having similar structures. Buttstock 100 is illustrated in use with a conventional extension tube 10. Buttstock 100 mounts over the extension tube sliding along its length and locks at select locations to effect the length of the buttstock relative to the rest of the firearm (not shown). As shown in FIGS. 3-6, extension tube 10 has a lower rib 12. A plurality of cylindrical recesses 15 are formed along the bottom of lower rib 12.

Buttstock assembly 100 consists of a main stock body 110 having interchangeable end attachments 160 and 170, and interchangeable sling strap connectors 180 and 190. Buttstock assembly 100 uses a "trigger" style locking mechanism to selectively position and lock main stock body 110 along the length of extension tube 10 to adjust the overall length of pull of the weapon. Interchangeable end attachments 160 and 170 mount to the main stock body 110 and have "toe" sections of differing lengths and configurations. In addition, buttstock assembly 100 includes a modular design to accept different sling strap connectors, including a quick disconnect swivel 180 and a traditional strap loop connector 190.

Main stock body 110 is constructed from suitable polymer plastic and formed by two symmetrical halves 112A and 112B that are fused or bonded together. The proximal end of main stock body 110 has a longitudinal passage configured to shiftably receive the extension tube 10. The distal end of main stock body 110 terminates in a flat end wall 114. Main body 110 has symmetrical cheek weld 116 on either side that are spaced forward of end wall 114. A connector slot 117 is formed in the rear face of both cheek welds 116. The distal end of main stock body 110 also has a pair of connector bosses 118 extending laterally from either side. Each connector boss 118 has an axial connector bore 119. The bottom of main stock body 110 has a trigger guard 120 and a plunger housing 128.

The locking mechanism used to position and lock main body 110 in place along extension tube 10 includes a trigger 130, trigger bar 132 and plunger 138 disposed between body halves 112A and 112B. Trigger 130 is shiftably seated within a slot formed between halves 112A and 112B inside trigger guard 120. Trigger bar 132 is shiftably seated within a longitudinal channel 121 formed between body halves 112A and 112B. The distal end of trigger bar 132 is connected to the top of trigger 130 by a pair of screw fasteners 133. The proximal end of trigger bar 132 terminates in an angled clevis 134. Trigger bar 132 is urged forward by coil spring 136, which is seated into a spring channel 137 formed between body halves 112A and 112B. Plunger 138 is shiftably seated within a vertical plunger well 129 formed in plunger housing 128. Plunger 138 is operatively connected to trigger bar 132 by a connector pin 139, which extends through elongated slots 135 in clevis 134 and through a hole in the plunger. Movement of trigger bar 132 drives plunger 138 up and down within plunger well 129 by the engagement of pin 139 inside slot 135 of angled clevis 134. Plunger 138 travels vertically in plunger well 129 formed in main stock body 110 and is pushed into one of extension recesses 15 along rib 12 by means of a spring 136, which drives trigger bar 132 forward. Pressing trigger 130 rearward pulls trigger bar 132 rearward against the tension of spring 136.

In the locked position (FIGS. 4 and 5), plunger 138 is forced upward to seat within one of the recess 15 of extension tube 10, thereby securing stock assembly 100 in place along the extension tube. Spring 136 urges trigger bar 132 forward lifting plunger 138 upward by the location of pin 139 at the distal end of slot 135. In the unlocked position (FIGS. 3 and 6), plunger 138 is forced downward and withdrawn from recess 15 to allow stock assembly 100 to slide freely along the length of extension tube 10. Manually pressing trigger 130 rearward to the unlocked position, pulls trigger bar 132 back withdrawing plunger 138 from recess 15 as pin 139 travels downward to the proximal end of slot 135.

Figure 7:
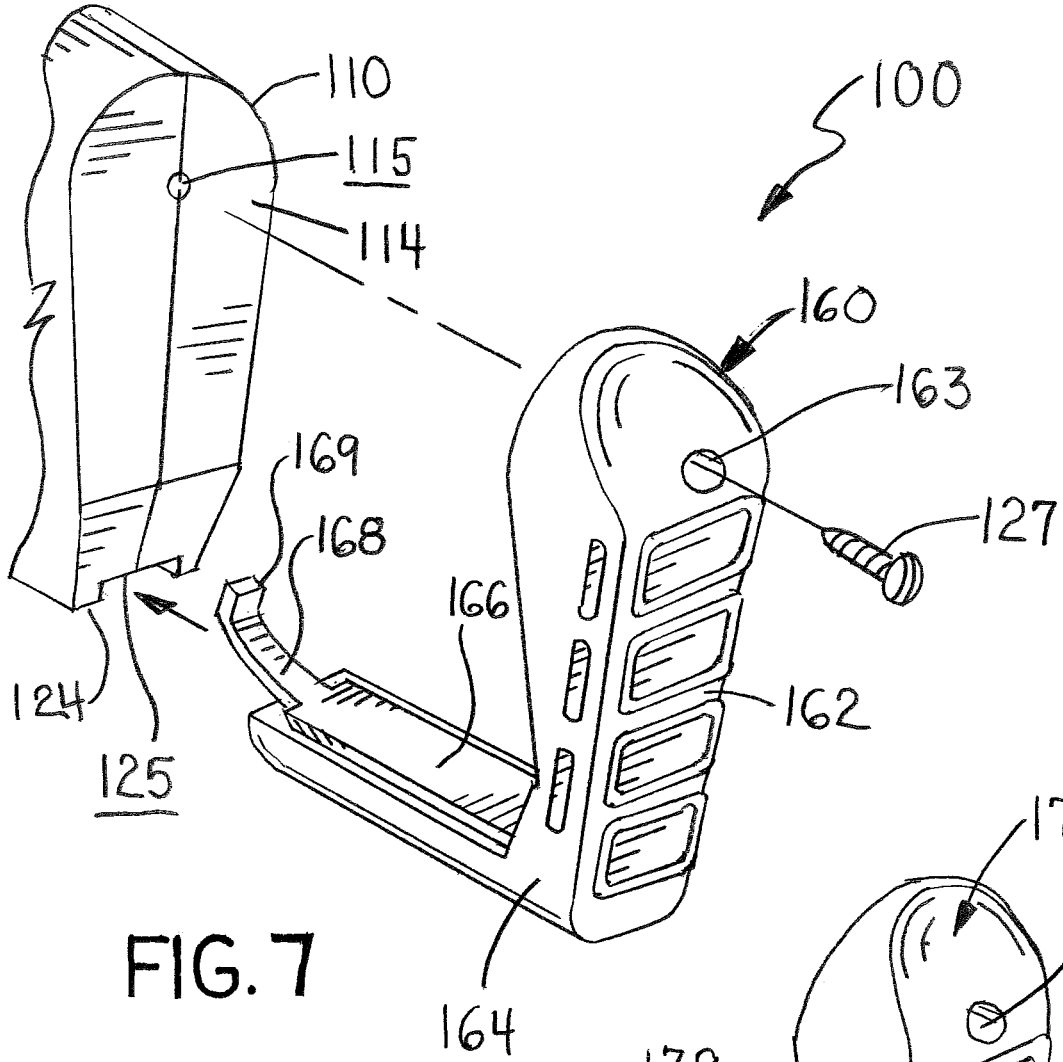
FIG. 7 is a partial exploded view of the buttstock assembly of FIG. 1 used with an exemplary embodiment of the end attachment.
Figure 8:
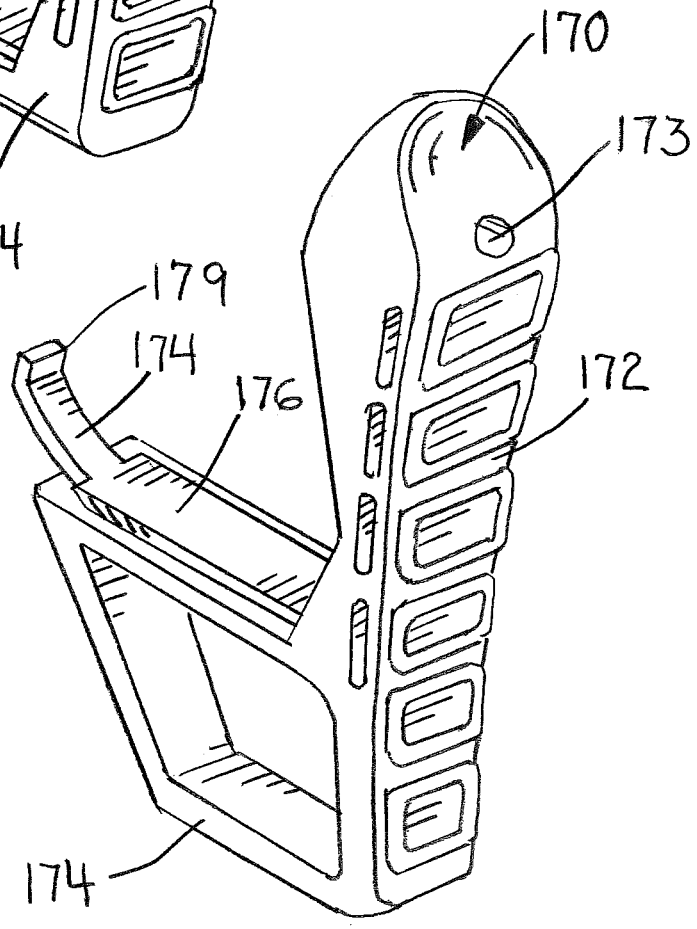
FIG. 8 is a partial exploded view of the buttstock assembly of FIG. 1 used with another exemplary embodiment of the end attachment.

FIGS. 7-10 illustrate two exemplary embodiments of the interchangeable end attachments 160 and 170 used within stock assembly 100. Each embodiment of the end attachments is designed to be affixed to the main stock body 110 as a buttplate with different toe lengths and configurations to stock assembly 100. Each embodiment has a similar construction. Typically, the end attachments are molded or formed of a polymer with a soft rubber over-mold. As shown in FIG. 7, end attachment 160 includes a butt plate section 162 and an integral toe section 164. End attachment 160 includes a raised toe plate 166 and toe hook 168 that terminate in a hook head 169. As shown in FIG. 8, end attachment 170 similarly includes a butt plate section 172 and an integral toe section 174. End attachment 170 includes a raised toe plate 176 and toe hook 178 that terminate in a hook head 179. End attachments 160 and 170 differ only in the length and configuration of toe section 164 and 174. As shown, end attachment 170 has a larger toe section 174, which gives a taller profile "toe" to stock assembly 100.

Figure 9:
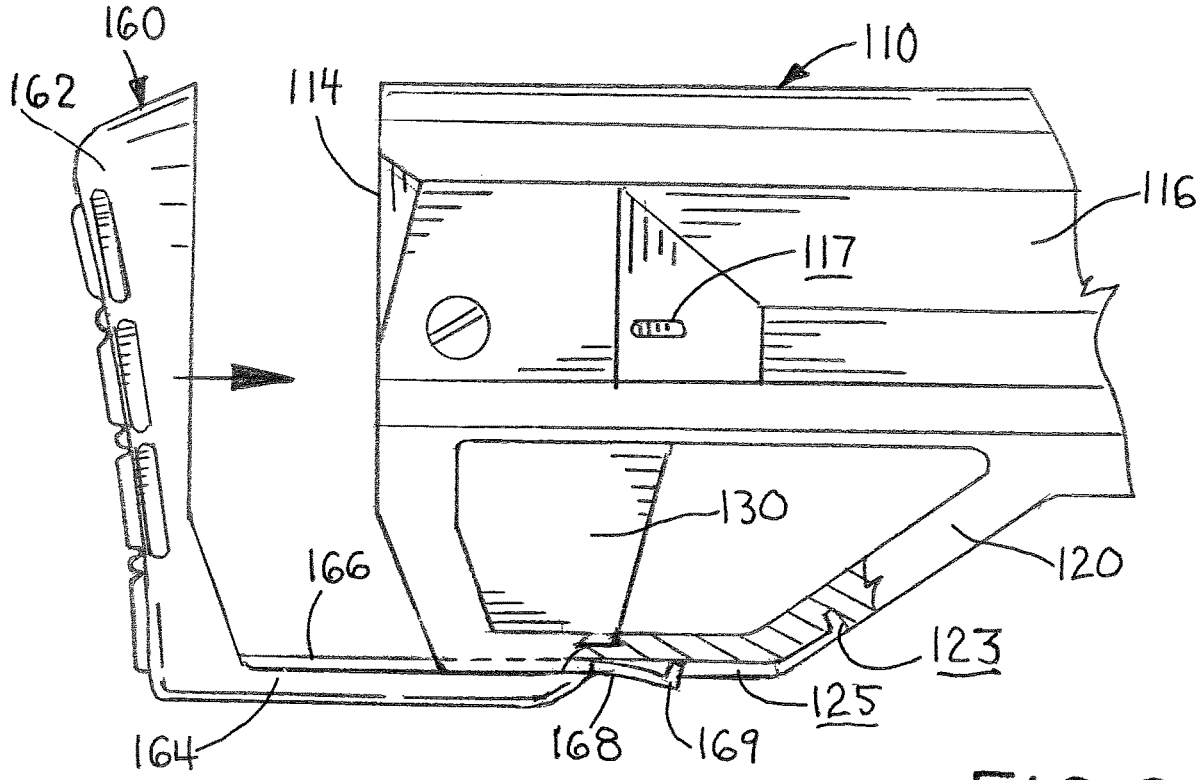
FIG. 9 is a partial right side view of the buttstock assembly of FIG. 7 showing the end attachment being mounted to the main stock body.
Figure 10:
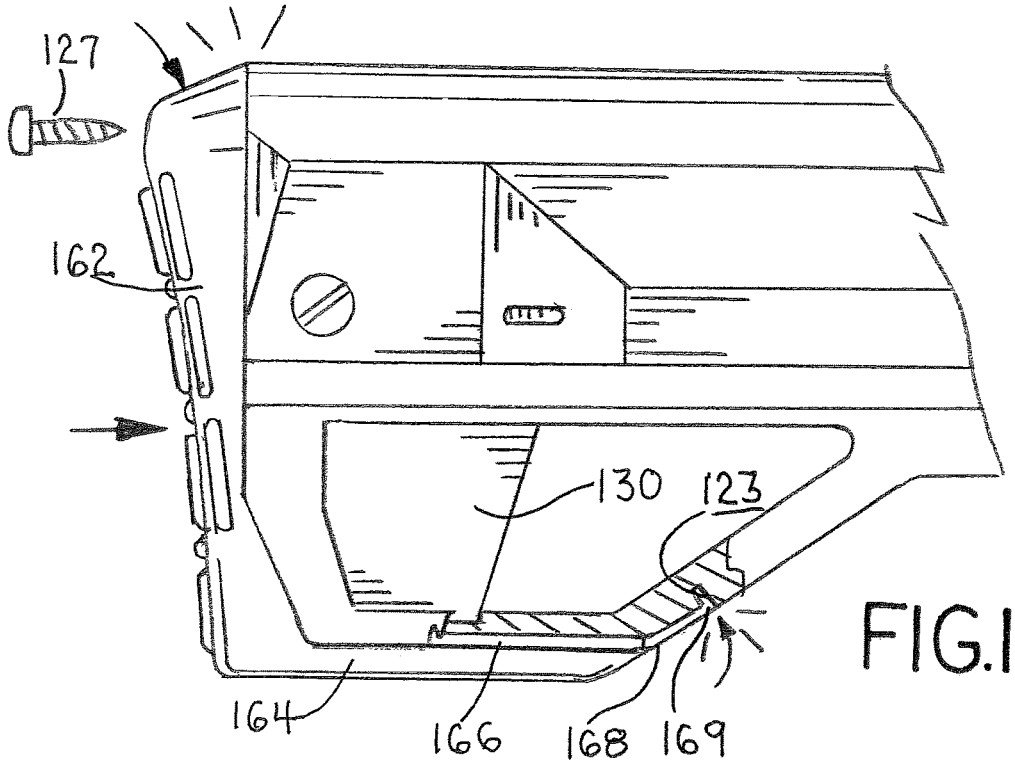
FIG. 10 is a partial right side view of the buttstock assembly of FIG. 7 showing the end attachment mounted to the main stock body.

End attachments 160 and 170 are secured to main stock body 110 in the same manner by a toe hook 168, 178 and a screw fastener 127. FIGS. 9 & 10 illustrate how end attachment 160 is connected to main stock body 110. It should be note that end attachment 170 is connected in the same manner. As shown, end attachment 160 slides onto main stock body 110 with toe plate 166 seating within a channel 125 formed in the bottom of trigger guard 120. Hook 168 bend and deflects slightly as toe plate 166 slide forward along channel 125 then conforms around the angle front face of trigger guard 120 (FIG. 9). When end attachment 160 is fully seated against main stock body 110, butt plate section 162 abuts end wall 114 and toe hook 168 abuts against the bottom trigger guard 120 with hook head 169 seated within opening 123. A screw fastener 127 extends through hole 163 in buttplate section 162 and is turned into opening 115 in end wall 155. Toe hook 168 with hook head seated within opening 123 holds toe section 164 against the bottom of trigger guard 120 and fastener 127 holds butt plate section 162 against end wall 114.

Figure 11:
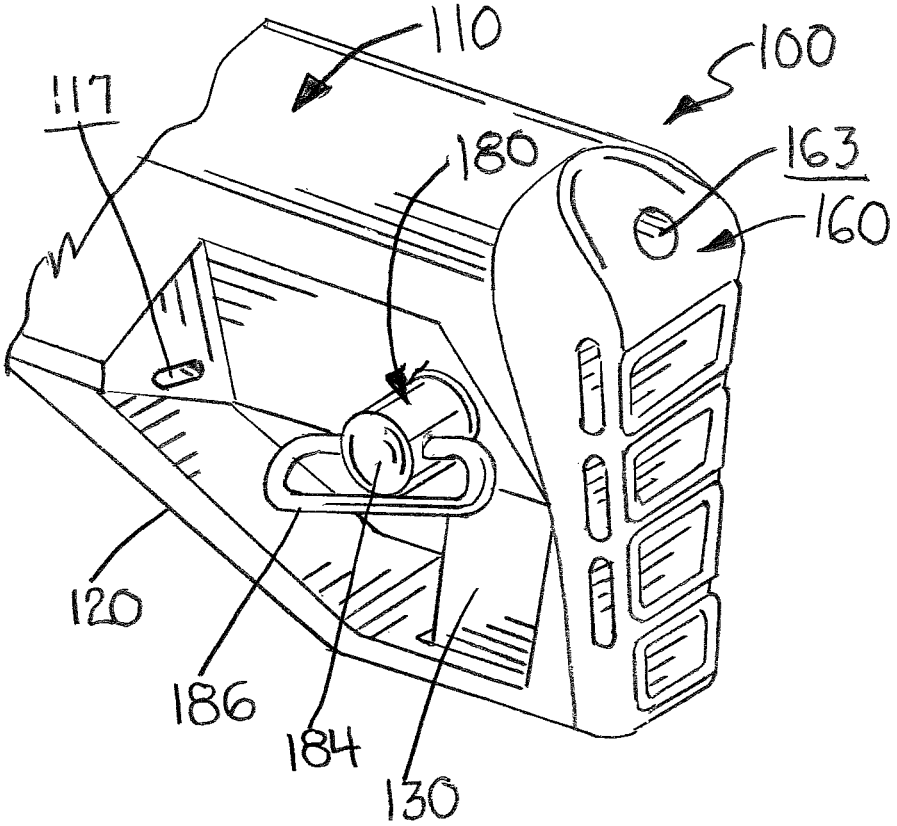
FIG. 11 is a partial perspective view of the buttstock assembly of FIG. 1 showing an exemplary embodiment of the sling strap connector mounted to the main stock body.
Figure 12:
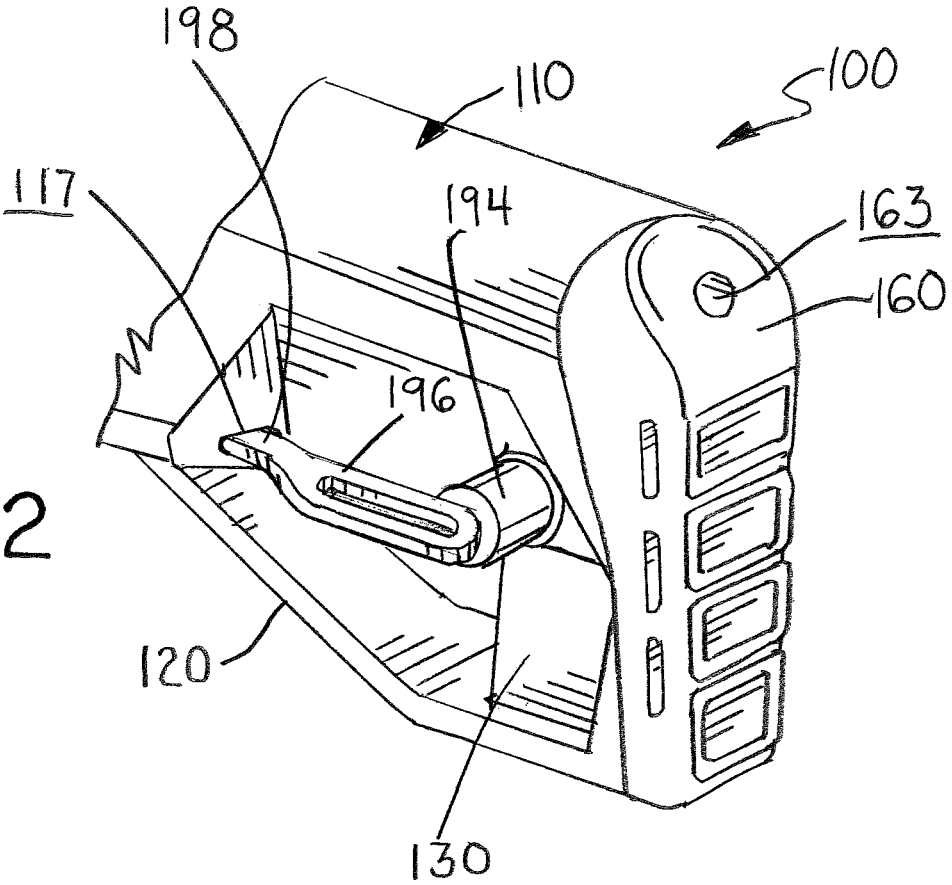
FIG. 12 is a partial perspective view of the buttstock assembly of FIG. 1 showing another exemplary embodiment of the sling strap connector mounted to the main stock body.
Figure 13:
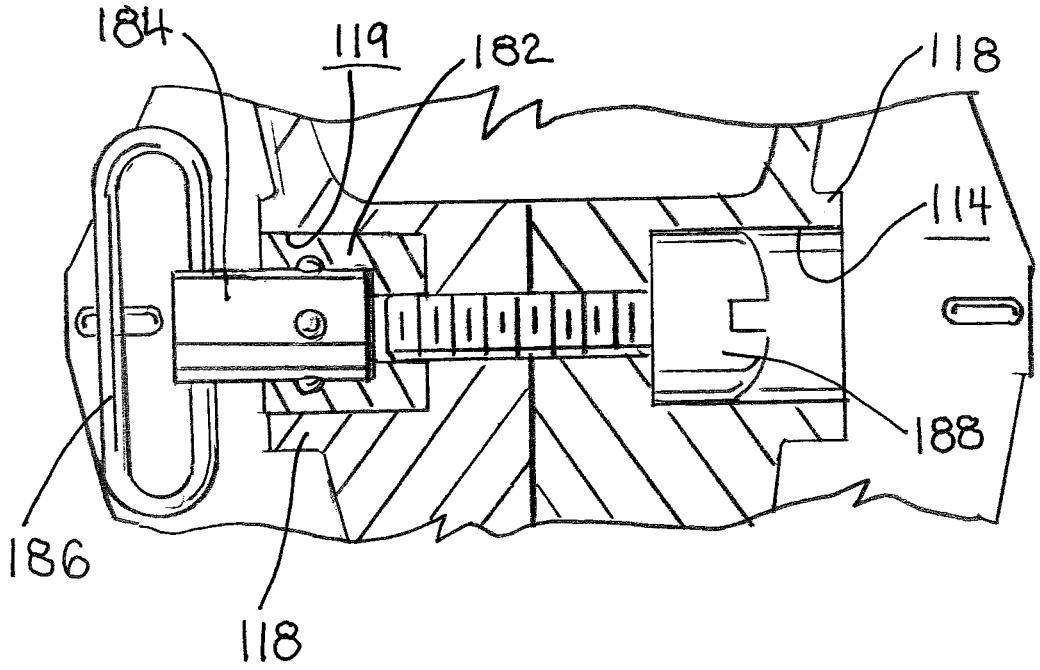
FIG. 13 is a partial end sectional view of the buttstock assembly of FIG. 1 showing the connection of the sling strap connector of FIG. 11.

FIGS. 11-13 illustrate two exemplary embodiments of the interchangeable sling connectors 180 and 190 used within stock assembly 100. Each sling connector 180 and 190 is designed to be affixed to main stock body 110 and provides different connectors for affixing sling straps to stock assembly 100. As shown in FIGS. 11 & 13, sling connector 180 is a conventional quick-disconnect style strap swivel, which spins relative to stock assembly 100. Sling connector 180 includes a swivel barrel 182 embedded in boss port 119, a conventional "QD" swivel head 184 and strap loop 186 for receiving a sling strap (not shown). Typically, swivel barrel 182 is securely seated within boss port 119 by fastener bold 188, but may be press fit into the port in certain embodiments. As with conventional quick-disconnect swivels, swivel head 184 is detachably seated within barrel 182. The swivel head has retractable bearings that extend into an annual groove formed in the inner wall of the barrel, which allows the swivel head to rotate, as well as hold the head within the barrel.

As shown in FIG. 12, sling connector 190 is a traditional "sling loop" style connector. Sling connector 190 includes a cylindrical loop head 194 and integral flat loop body 194 for receiving a sling strap (not shown). As shown, loop head 194 is fitted into a similar barrel as barrel 182, which secures one end of the loop body 194 to main stock body 110. Again, the barrel is seated within boss port 119. The other end of loop body 194 terminates in a hook end 198, which seats within slot 117 of the cheek weld 116. With hood end 198 seated within slot 117 and loop head 194 affixed within the barrel fitted inside boss port 119, sling connector 190 is securely mounted to main stock body 110.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

We claim:

1. A modular buttstock assembly for a firearm comprising:

a main stock body having a proximal end and a distal end thereof, the proximal end adapted to mount to the firearm, the main stock body also has a bottom wall thereof and an end wall at the distal end of the main body; and an end attachment detachably mounted to the main stock body to extend from the end wall and the bottom wall, the end attachment includes an end plate that engages and abuts flat against the end wall, a toe section extending from the end plate that engages and abuts the bottom wall, and a hook part extending from the toe section that engages the bottom wall between the distal end of the main stock body and the proximal end of the main stock body when mounted to the main stock body.

* * * * *